US006321513B1

(12) United States Patent
Meixner

(10) Patent No.: US 6,321,513 B1
(45) Date of Patent: Nov. 27, 2001

(54) METHOD FOR PACKING ARTICLES IN AN ELASTIC PACKING MATERIAL AND DEVICE TO CARRY OUT SAID METHOD

(75) Inventor: Hans-Werner Meixner, Wettenberg (DE)

(73) Assignee: Pi-Patente Gesellschaft mit beschränkter Haftung (GmbH) Entwicklung und Verwertung, Wettenberg (DE)

( * ) Notice: Subject to any disclaimer, the term of this patent is extended or adjusted under 35 U.S.C. 154(b) by 0 days.

(21) Appl. No.: 09/284,545

(22) PCT Filed: Sep. 26, 1997

(86) PCT No.: PCT/EP97/05284

§ 371 Date: Apr. 15, 1999

§ 102(e) Date: Apr. 15, 1999

(87) PCT Pub. No.: WO98/17534

PCT Pub. Date: Apr. 30, 1998

(30) Foreign Application Priority Data

Oct. 17, 1996 (EP) ..... 96116634

(51) Int. Cl.[7] ..... B65B 53/00

(52) U.S. Cl. ..... 53/441; 53/434; 53/556; 53/512

(58) Field of Search ..... 53/441, 556, 434, 53/86, 512, 557, 459, 386.1, 432, 219

(56) References Cited

U.S. PATENT DOCUMENTS

| | | | | |
|---|---|---|---|---|
| 2,201,706 | * | 5/1940 | Sukohl | 53/441 |
| 3,777,446 | * | 12/1973 | Graver | 53/219 |
| 3,958,391 | * | 5/1976 | Kujubu | 53/95 |
| 4,164,111 | * | 8/1979 | Di Bernardo | 53/441 |
| 4,541,224 | * | 9/1985 | Mugnai | 53/434 |
| 4,903,459 | * | 2/1990 | Okinaka | 53/434 |
| 4,922,686 | * | 5/1990 | Segota | 53/434 |
| 4,924,919 | * | 5/1990 | Oyler | 53/441 |
| 5,044,142 | * | 9/1991 | Gianelli | 53/434 |
| 5,732,535 | * | 3/1998 | Mitsuta | 53/432 |
| 5,746,041 | * | 5/1998 | Tolson | 53/442 |
| 5,873,969 | * | 2/1999 | Keith et al. | 53/459 |

FOREIGN PATENT DOCUMENTS

| | | |
|---|---|---|
| 2446771 | 8/1980 | (FR) . |
| 41 197 | 4/1962 | (LU) . |
| 203045 | 5/1985 | (NZ) . |
| 223386 | 11/1990 | (NZ) . |
| 248962 | 3/1996 | (NZ) . |

* cited by examiner

*Primary Examiner*—Scott A. Smith
*Assistant Examiner*—Sam Tawfik
(74) *Attorney, Agent, or Firm*—Collard & Roe, P.C.

(57) ABSTRACT

The method relates to a method for packing articles and/or objects. Articles are packed in an elastic packing material (2) and the elastic packing material is stretched during the packing process. To achieve this, the packing material is arranged in a receptacle (1) in which a partial vacuum is produced. The packing material is stretched due to the pressure that the outside air exerts upon it. The item that is to be packed is then placed in or on the packing material. Once the vacuum has been removed, the packing material automatically reverts back to its original position by virtue of its own elasticity and is applied to the packing items. The invention also relates to a device to carry out such a method.

30 Claims, 12 Drawing Sheets

METHOD FOR PACKING ARTICLES IN AN ELASTIC PACKING MATERIAL AND DEVICE TO CARRY OUT SAID METHOD

BACKGROUND OF THE INVENTION

1. Field of the Invention

The invention relates to a method for packaging articles and/or objects and a device for carrying out said method.

2. Description of the Related Art

According to the prior art, articles or objects of the most different kinds are packaged with various packaging materials.

According to the prior art, articles or objects, including foods, are packaged with packaging materials which are formed elastically. On account of the packaging methods belonging to the prior art, the fields of application for these packaging methods, in which the articles or objects are packaged with elastically formed packaging materials, are very limited.

The packaging methods belonging to the prior art for a packaging of an article or object with a elastic packaging material are executed on the one hand with the aid of stretchers.

Hereby an expansion of the elastic packaging material is attained by means of the varying running speeds of rollers between which the elastic packaging material is guided. After the expanding of the packaging material, the article to be packaged is placed on or in the packaging material, and the elastic packaging material contracts through its restoring forces.

This method belonging to the prior art has the disadvantage that damage to the packaging material may occur through the expanding of the packaging material by means of the rollers.

The method belonging to the prior art is moreover very cost-intensive, as the mechanical expansion has to be executed very quickly on the one hand and high forces have to be generated for the expansion on the other.

Moreover, the packaging method belonging to the prior art has the disadvantage that it is hardly possible to pull the packaging material in its length and simultaneously in its width by means of the stretchers.

A further disadvantage of this method is that the expansion forces to be generated pull the elastic packaging material into a smooth, monoplane shape and thus a simultaneous shaping of the packaging material is not possible. For example, the packaging material formed as a monoplane foil becomes larger during expansion. It always remains, however, a monoplane foil and does not form a shape, for example a sleeve or the like.

A further disadvantage is that the force applied for expanding the elastic packaging material always acts on the packaging material only linearly at the contact points between the rollers. With this method, the entire force needed to expand the total surface of the packaging material is applied between two pairs of rollers at one point. This very often results in damage.

On the other hand, the prior art includes a packaging method (DE 39 08 585 C2) in which, for example, meat is packaged in elastic packaging material. This method belonging to the prior art provides for rods which are located parallel or approximately parallel or else conically to one another in a circle or approximately a circle. On the outside of the circle formed by the rods, the elastic packaging material is located In the form of a sleeve or bag. The meat is pushed through between the rods. For the expanding of the packaging material there are now two possibilities:

Either the packaging material is already placed in pre-expanded state on the rods, i.e. the packaging material is expanded by mechanical means which act on the rods, or the packaging product must induce an expansion of the elastic packaging material during the pushing through the rods by forcing the rods and the packaging material apart.

When pushing a joint of meat, for example, along the rods, the packaging material is pulled down by the rods. The packaging foil is applied to the meat with a pressure acting from all sides on the meat.

With this method it is indeed possible for the packaging foil to have a shape (sleeve shape).

However, this method belonging to the prior art has the disadvantage that the packaging method is not suitable for many products because the expansion of the rods and of the packaging material has to be induced by the product. One example to be given in this context is the packaging of diapers, as the diapers, due to their deformability, are not in a position to force the rods and the packaging material apart in a defined way. On being pushed through, the diapers are compressed by the confronted pressure instead of forcing the rods apart.

If the expanding of the packaging material is to be induced by the mechanical means acting on the rods, so that diapers, for instance, can be packaged, very complex mechanical constructions are necessary for this purpose.

A further disadvantage of this packaging method belonging to the prior art is that the expansion means used are always inside the packaging during the packaging procedure and can thus severely impede the packaging procedure.

SUMMARY-OF THE INVENTION

Moreover, this method belonging to the prior art has the disadvantage that it can be executed only very slowly.

The technical problem underlying the invention is in specifying a method for the packaging of articles and/or objects, including foods, according to which the articles and/or objects can be packaged by a simple means in a elastic packaging material, with which the elastic packaging material is expanded in the packaging procedure, and in which the packaging material is strained as uniformly as possible and thus only little per area unit during the packaging procedure, in order to prevent damage to the packaging material. Furthermore a method is to be specified in which the expansion means for the elastic packaging material do not impede the packaging procedure. Moreover, the packaging material is to be expanded uniformly and/or in a defined manner so that it clings after the packaging under a desired pressure to the commodity to be packaged. A packaging method is to be specified in which the elastic packaging material is expanded in such a way that the elastic packaging material assumes predefined shapes in order to meet the differing demands of various articles or objects to be packaged. Moreover, a packaging method is to be specified with which it is possible to package articles or objects from the most diverse areas. Moreover, a device for carrying out the method is to be specified.

In accordance with the method according to the invention, elastic packaging material is exposed to an atmospheric differential pressure in a receptacle, A partial vacuum is generated in the receptacle between the packaging material and the receptacle wail. The external air pressure acts on the other side of the packaging material. By this means the elastic packaging material is expanded and the commodity to be packaged is then placed on and/or under or in the expanded packaging material. The partial vacuum is then released. The elastic packaging material is restored, at least to the extent that is clings at least partially to the commodity to be packaged.

The elastic packaging material is made, for example, of polyolefin elastomer or polyurethane elastomer and of monoplane configuration. It is possible to use a single-ply or multi-ply foil. In the case of a multi-ply foil, at least one foil ply can consist of another material. For example, the combination with polyvinyl dichloride (PVDC) or ethylene vinyl alcohol (EVOH) is possible in order, for example, to increase the gas impermeability of the foil.

In the method according to the invention, foils which have a ply thickness of between 20 and 200 $\mu$m are used with preference. The expandability in the elastic area of the foil is advantageously between 30% and 400%. With most packagings it is practicable to work with an expansion of around 50% to 150%.

In accordance with the method according to the invention, the external air pressure acting on the entire surface of the packaging material acts as an expansion force in that a partial vacuum is generated on the opposite side of the packaging material. Depending on how great the partial vacuum is, the external air pressure acts as an expansion force between 0 bar and almost 1 bar per $cm^2$ of the packaging material.

For example, a pressure of up to approximately 100 kg acts on a 10 cm×10 cm large piece of the packaging material, which pressure is sufficient also to induce the expansion of very strong elastic foils.

Elasticity is taken to mean the independent resumption of the former shape after a change of shape. Elasticity is the characteristic of solid bodies to cancel again their change of shape (deformation) assumed under the action of external force after cessation of the action of the force (Brockhaus, 18th edition (anniversary edition)).

The method according to the invention has the advantage that the elastic packaging material is exposed during the expansion procedure to no strains acting through mechanical devices such as rods, stretchers, rollers or the like, which devices often lead to damage to the elastic packaging material.

The method according to the invention has moreover the advantage that the expansion means do not impede the packaging procedure. As the packaging material is located in a receptacle in which a partial vacuum is generated and as the packaging material is expanded by the external air pressure, the commodity to be packaged can be placed on and/or under or in the packaging material in a simple manner. There are, for example, no rods or the like, which are to expand the packaging material, in the way. The external air pressure as an expansion force is indeed present. It does not, however, disturb the packaging procedure.

After the releasing of the partial vacuum, the packaging material clings to the commodity to be packaged without mechanical expansion means between the packaging material and the commodity to be packaged having to be removed. The air between the packaging material and the commodity to be packaged is displaced.

Moreover, the packaging material in accordance with the method according to the invention is expanded extremely uniformly by the action of the external air pressure. In accordance with the method according to the invention, it is possible to undertake longitudinal and transverse expansions simultaneously in the packaging material. It is, however, also possible to undertake local overexpansions, for example, as edge protection for the commodity to be packaged or as protection for the packaging material. Furthermore, It is possible to give the elastic packaging material during the expanding any shapes which are suited to the commodity to be packaged.

The packaging method according to the invention has moreover the advantage that it can be used on principle in all packaging areas.

By this means it is now possible to use packaging material universally, which is not possible according to the prior art.

This means that the advantages of the elastic packaging material can be utilized for the first time in other packaging areas than in the packaging areas belonging to the prior art.

Among the advantages of the elastic packaging material is the advantage that, after the packaging procedure, the elastic packaging material clings uniformly and closely to the commodity to be packaged through the restoring forces acting in the packaging material on account of the elasticity.

Moreover, in accordance with the method according to the invention, a packaging material can be used which compresses the product after the packaging or even during the packaging procedure or exerts a uniform multi-side or all-side pressure on the packaged commodity, which is advantageous in the packaging of diapers, hygiene paper, sanitary pads or the like. For example, the volume of diapers can be compressed by up to half in accordance with-the method according to the invention, which compression permits substantial savings in logistics.

Moreover, in accordance with the packaging method according to the invention, the air between the commodity to be packaged and the packaging material is automatically displaced, which is desired in particular in the packaging of foods. This replaces the extremely resource-intensive vacuum packaging methods belonging to the prior art in many packagings.

As each packaging material has in general to be larger during the packaging procedure than the commodity to be packaged, useless and unsightly material surpluses occur with the packaging materials belonging to the prior art. These material surpluses can on the one hand be removed in additional operations by sealing off, cutting off or the like. These material surpluses can, however, also be concealed by shrinking or pressing against the packaging material. It is also possible to let these material surpluses project in an unattractive manner over the packaging, for example in the case of vacuum packagings for meat, which is, however, done only in very few cases. This gives rise according to the prior art to the disadvantage that an additional operation is necessary in most cases and that undesired material cut-offs are moreover present.

The elastic packaging material which is used in accordance with the packaging method according to the invention does not have these disadvantages.

Through the method according to the invention, it is possible that the material is elastically expanded during the packaging procedure and that the packaging material then clings automatically to the commodity to be packaged as a result of the restoring forces of the packaging material. In accordance with the method according to the invention, it is possible to use the elastic packaging material universally for many products.

In doing so, the following is achieved: On expanding, the packaging material becomes thinner in its ply thickness. On restoration of the packaging material, no material surpluses occur, but the packaging material becomes thicker again in its ply thickness and thus attains the ply thickness necessary for the packaging. No material surplus originates. By this means a material saving of up to 50% compared with the prior art is attained.

The stability of a packaging is yielded predominantly by the thickness of the packaging material after the packaging. The thickness of the packaging material during the packaging does not ply such a substantial role.

According to the invention, the method for the packaging of articles relates to elastic packaging material in most varied configurations and types.

Methods for packaging commodities in packaging materials are described below, which materials are formed as an elastic bag, as an elastic sleeve or as an elastic monoplane foil.

1. Bag

A bag consists, for example, of two monoplane foil pieces, for example squares, which are superimposed, and with which three lateral edges are firmly connected with one another in such a way that the bag has an open end. This bag is placed with its open end contacting the all-round edge of a receptacle or overlapping the all-round edge of the receptacle in such a way that a space is formed between the external surfaces of the bag and the internal side of the receptacle, in which space a partial vacuum is generated. Through the external air pressure, the bag is expanded in the space. The commodity to be packaged is then inserted into the thus expanded bag. Once the partial vacuum in the space has been released, the bag clings automatically to the packaged article on account of the restoring forces present in the bag material.

The bag can be placed with its open end in unexpanded or else in expanded state contacting the all-round edge of the receptacle or overlapping same.

The bag is advisedly configured in such a way that it has a larger diameter in the region of its opening than in the central or end region of the bag. This has the advantage that the bag can be placed by simple means with its open end In slightly expanded state overlapping the all-round edge of the receptacle.

The receptacle is advisedly configured in such a way that it is variable in size. The receptacle can be configured adjustably in the length, width and/or depth. The length of the receptacle can, for example, be adjustable by means of a telescopic configuration of the receptacle. The internal space of the receptacle can also be configured variably by means of a piston located in the receptacle.

2. Sleeve

If the elastic packaging material is configured as a sleeve with two open ends, the sleeve is guided through the receptacle. The one open end of the sleeve is placed, like the bag, contacting the all-round edge of the receptacle or overlapping same. The other end of the sleeve is placed in an infeed device of the receptacle and can be continuously pulled off a dispenser roll. Advantageously the infeed device for the sleeve is placed in an axially displaceable piston in the receptacle so that the length of the receptacle and thus the length of the packaging envelope can be varied by displacing the piston. The piston is fixable in the receptacle so that it is not displaced when the external air pressure acts.

The sleeve portion placed in the receptacle is advisedly drawn tight before the sleeve portion is expanded by generation of the atmospheric partial vacuum and acting of the external air pressure in that the dispenser roll on which the sleeve is located is turned back. This has the advantage that the sleeve portion in the receptacle does not cling to the receptacle wall during the expanding in folds or waves or in another non-uniform manner.

Through generation of a partial vacuum and action of the external air pressure, the sleeve portion located in the receptacle is expanded in the same way as the bag, and the commodity to be packaged can be inserted into the sleeve. The partial vacuum is then released. The packaging material is restored by its elasticity, displacing the air-between the commodity to be packaged and the packaging material. The sleeve portion clings automatically to the inserted commodity to be packaged.

A welding device as well as a device for placing a perforation line are advisedly provided in addition in the piston. Sleeve portions can be detached from the sleeve at the perforated places.

Depending on the commodity to be packaged, the sleeve portion can be closed, in particular thermally welded, at one or at both ends.

When the sleeve portion with the packaged commodity is pulled out of the receptacle, the subsequent sleeve is automatically pulled forward in such a way that a sleeve portion is once again placed in the receptacle and can be placed with the open end at the all-round edge of the receptacle.

3. Bag and Sleeve

Advantageously the receptacle has on the outside retaining means for the bag opening or the sleeve opening. The retaining means are advisedly hook-shaped, and the hooks point away from the receptacle. Once the bag or the sleeve is placed with the opening of the open end on the retaining means, the retaining means are moved pneumatically or hydraulically or electrically in such a way that the bag opening or the sleeve opening lies with tension at the hooks and on and/or at the all-round edge of the opening of the receptacle and thus seals or approximately seals the space of the receptacle against the external space in such a way that a partial vacuum can be generated between the bag or sleeve and the receptacle.

The retaining means can be moved parallel to the surface line of the, for example, cylindrically or cuboidally configured receptacle. It is, however, also possible to move the retaining means radially outwards away from the receptacle.

A further retaining possibility for the bag or sleeve consists in that the receptacle has a double-wall configuration and a partial vacuum is generable in the cavity between the receptacle walls. The receptacle has in the region of the receptacle opening as a retaining device for the edge of the sleeve opening or bag opening at least one further opening, through which the packaging material is drawn in and retained through the partial vacuum generated between the receptacle walls.

The inner receptacle wall determines the geometry of the bag or of the sleeve when a partial vacuum is generated which is so great that the bag or the sleeve clings to the receptacle wall on account of the external air pressure.

The double-walled embodiment has the further advantage that, on the one hand, the geometry of the external wall of the receptacle can be selected in such a way that it is stable enough to counteract the atmospheric forces occurring on generation of the partial vacuum. A cylindrical shape, for example, has proved to be advantageous.

On the other hand, the double-walled embodiment of the receptacle has the advantage that, with a constant geometry of the external wall of the receptacle, receptacle internal walls deviating from same can be provided so that various geometries can be preselected for the packaging material. By this means, even exceptionally complex geometries can be preselected. As the external air pressure acts via the packaging material only on the inside of the inner wall of the receptacle, the forces hereby acting radially outwards are largely eliminated by counteracting tensile forces in the inner wall of the receptacle. As a result, plastic, for example, can be used as material for the inner wall of the receptacle instead of heavy steel, so that it is possible at all on the one hand to preselect complex geometries and on the other hand a substantial cost saving is achieved by this means.

Furthermore, the inner walls of the receptacle can be designed interchangeably, so that only one packaging device with an outer wall of the receptacle is necessary in order to preselect various geometries for the packaging material by means of the inner wall of the receptacle.

With the double-walled configuration, the inner wall of the receptacle is advisedly configured as a screen. It is, however, also sufficient if the inner wall of the receptacle has sufficient openings to guarantee an approximately uniform pressure in the entire inside space of the receptacle.

In the case of certain commodities to be packaged, the partial vacuum generated in the receptacle is advisedly eliminated in that at least one opening is provided in the packaging material through the commodity to be packaged on placement of the commodity to be packaged. Air will flow through the opening provided in the packaging material into the space in which the partial vacuum was generated, so that the partial vacuum is eliminated. This has the advantage that the partial vacuum has not to be eliminated by the device generating the partial vacuum but that the partial vacuum is eliminated automatically during the placement of the commodity to be packaged. By this means, photosensors, for example, can be renounced, which photosensors would have to signal to a control for elimination of the partial vacuum that the commodity to be packaged is placed in the packaging material.

4. Monoplane Foil

If the packaging material is configured as monoplane foil, said foil can be used singly or multiply simultaneously.

4. a) Use of a Single Monoplane Foil

If a monoplane foil is used, it is guided according to the invention over the all-round edge of a receptacle, whereby the receptacle is advantageously configured as a trough. The monoplane foil seals the space of the receptacle against the external space, and a partial vacuum is generated in the receptacle. Through generation of the partial vacuum, the external air pressure acts on the monoplane foil and same is expanded and pressed into the trough of the receptacle. The commodity to be packaged can be placed on the expanded monoplane foil. The lateral edges of the monoplane foil are then brought together. The lateral edges of the monoplane foil are then welded and the atmospheric partial vacuum is released. It is, however, also possible first to release the atmospheric partial vacuum and then to weld the lateral edges.

The lateral edges of the monoplane foil can be thermally welded with one another. It is, however, also possible to connect the lateral edges of the monoplane foil firmly with one another by other means, for example by bonding. In all events, a sleeve is obtained from the monoplane foil.

The sleeve is advantageously separated into sleeve portions. For this purpose, perforation lines are advisedly provided in the sleeve.

According to need, the ends of the monoplane foil sleeve portion can then also be closed.

According to this method, it is possible to guide the monoplane foil continuously or time-pulsed through the packaging device.

The monoplane foil is advantageously guided by means of conveying means, such as chains, belts or the like.

The conveying means can serve simultaneously as sealing means between the monoplane foil and the all-round edge of the receptacle.

4. b) Use of More Than One Monoplane Foil

If at least two monoplane foils are used, at least two receptacles are advantageously placed opposite each other. Fundamentally, the expanding procedure is executed in the same way as the expanding procedure with a monoplane foil. The commodity to be packaged is placed between the monoplane foils. The lateral edges of the monoplane foils are brought together and connected firmly with one another.

4. c) Tableau packaging

A tableau is a platen-shape configured material on which the commodity to be packaged is placed. It is possible to guide the commodity to be packaged, which commodity is placed on the tableau and is to be packaged with an elastic monoplane foil, through a device which has a receptacle in which the elastic monoplane foil is expanded. The tableau is placed with the commodity to be packaged in such a way that the expanded monoplane foil is placed in the receptacle over the commodity to be packaged. After the release of the partial vacuum, the monoplane foil clings to the commodity to be packaged. Hereby, the lateral edges of the monoplane foil are held mechanically at the edges of the tableau. The lateral edges of the monoplane foil can now be welded with the tableau. By this means, salmon, for example, can be packaged.

5. General

According to the invention, it is possible to build up a partial vacuum in the receptacle in such a way that the bag, the sleeve or the monoplane foil is expanded as far as the receptacle wall and the geometry of the packaging material adapts to the receptacle wall. If the packaging material is configured as a sleeve, for example, said sleeve has a cylindrical shape. If a pipe with a square cross section is selected as a receptacle for this, a shape square in cross section is likewise forced upon the sleeve. In the longitudinal course, however, the packaging material still remains a sleeve.

It is, however, also possible that the packaging material clings only partially to the receptacle wall. This has the advantage that, in the event of the material hardly clinging to the wall, the adhesion forces are very strongly reduced, as a result of which a continuous forward movement of the packaging material in the receptacle is possible. On the other hand, the shape of the packaging material is nonetheless determined by the partial clinging to the receptacle wall.

If a sleeve, for example, is again selected as packaging material and a square cross section pipe as receptacle, the sleeve clings only partially in this case to the lateral walls of the square cross-section pipe. The sleeve does not reach thereby completely into the corners but spans them radially.

It is, however, also possible according to the invention to select the partial vacuum in such a way that the packaging material is expanded only to the extent that a clearance remains between the receptacle wall and the packaging material. In this case the geometry of the expanded packaging material is determined solely by the geometry preselected for the packaging material.

In this case it is, for example, possible to configure the packaging material as an elastic glove. The elastic glove is expanded by a certain amount in that the atmospheric partial vacuum necessary for the expanding is built up in the receptacle and the external air pressure acts on the inside surfaces of the elastic glove. This has the advantage that an elastic glove fitting in unexpanded state close to the skin can be put on without difficulty, as said glove is larger in expanded state than the hand. On cancellation of the expansion, the elastic glove clings automatically to the hand. This is advantageous for use in hospitals or in laboratories in which closely fitting, mostly sterile gloves have frequently to be put on.

With various packagings it is advisable to provide weld seams and/or perforation lines. The weld seams or perforation lines to be provided in the bag, the sleeve and the monoplane foil sleeve portion are advantageously curved so that the weld seam adapts in shape to the packaged commodity.

6. Elastic Restoring Forces

The method according to the invention has the advantage that the commodity to be packaged can be compressed during the packaging or after the packaging procedure by the packaging material on account of the restoring forces acting in the packaging material. This is, for example, advantageous for the packaging of diapers, hygiene paper, sanitary pads or the like, which are allowed to have only a very small space requirement for transport, storage and marketing.

A large number of products are configured non-compressibly or hardly compressibly yet formably. Through the elastic packaging material, a forming of the product, for example of a joint of meat, into a circular or approximately circular cross-sectional shape is achieved.

In the case of products which are neither compressible nor readily formable, the clinging of the packaging foil and the thus attained saving in material is desired, for example, in the case of beverage cans in packs of six.

If no further restoring forces or only limited restoring forces of the packaging material are to act after the packaging procedure on the commodity to be packaged, there are three possibilities:

a) On the one hand, the packaging can be adapted to the commodity to be packaged in such a way that the restoring forces of the packaging material are equal to zero or approximately equal to zero after the packaging procedure.

b) Furthermore, it is possible to undertake overexpansions of the packaging material during the expanding of the packaging material, which overexpansions are advisedly configured as local overexpansions. By this means it is attained that, for example in the area of edges of the commodity to be packaged, the restoring forces of the elastic packaging material are zero or approximately zero, so that by this means an edge protection of the commodity to be packaged is attained. For example, this is desired in the packaging of carton-packaged milk (milk pallets).

c) According to the invention, the packaged commodity can be heated, for example to 85° C. with the polyolefin elastomer used as packaging material. The heating temperature must in all events remain below the melting point of the packaging material, Through the heating, it is achieved in the case of polyolefin elastomers that the material is stress-relieved.

The following is given as an example of the stress-relieving of the packaging material:

If the packaging material is expanded, for example, during the packaging procedure by 100% to 180% and if it contracts to 140% around the commodity to be packaged, the packaging material without being heated would contract again to approximately 100% after the unpacking of the packaged commodity. If the packaging material is heated, however, the packaging material will not contract below 140%, The packaging material is, however, still elastic in the range between 140% and 180%.

This has the advantage that, for example on the unpacking of the packaged commodity, such as the diapers, the packaging material does not continue to contract and possibly make the unpacking more difficult.

If the method according to the Invention is applied to elastic gloves, the gloves normally continue to press on the hands through further action of the restoring forces even after the automatic fitting. If the gloves, however, are made of a corresponding elastic material, for example, polyolefin elastomer, the gloves can be heated after being fitted to the hands, so that the material is stress-relieved. The packaging material in the form of the gloves, however, remains elastic, i.e. when the user closes his outstretched hand, a new expansion occurs on the upper side of the hand, and when he opens his hand, said expansion is restored.

Advantageously, the receptacle in which the packaging material is expanded is adapted in its geometry to the commodity to be packaged. This means that, for example with a circular cross section commodity to be packaged, the receptacle likewise has a circular cross section slightly enlarged compared with the commodity to be packaged.

Advantageously, the geometry of the receptacle can, however, also be shaped deviatingly from the commodity to be packaged. This means that, with a circular cross section commodity to be packaged, the cross section of the receptacle can, for example, be shaped semicircularly. In this case, the base of the receptacle is formed flat, which may be advantageous when loading the packaging device.

BRIEF DESCRIPTION OF THE DRAWINGS

Other objects and features of the present invention will become apparent from the following detailed description considered in connection with the accompanying drawings.

It is to be understood, however, that the drawings are designed as an illustration only and not as a definition of the limits of the invention. In the drawings, wherein similar reference characters denote similar elements throughout the views.

DETAILED DESCRIPTION OF THE PREFERRED EMBODIMENT

Figure 1:
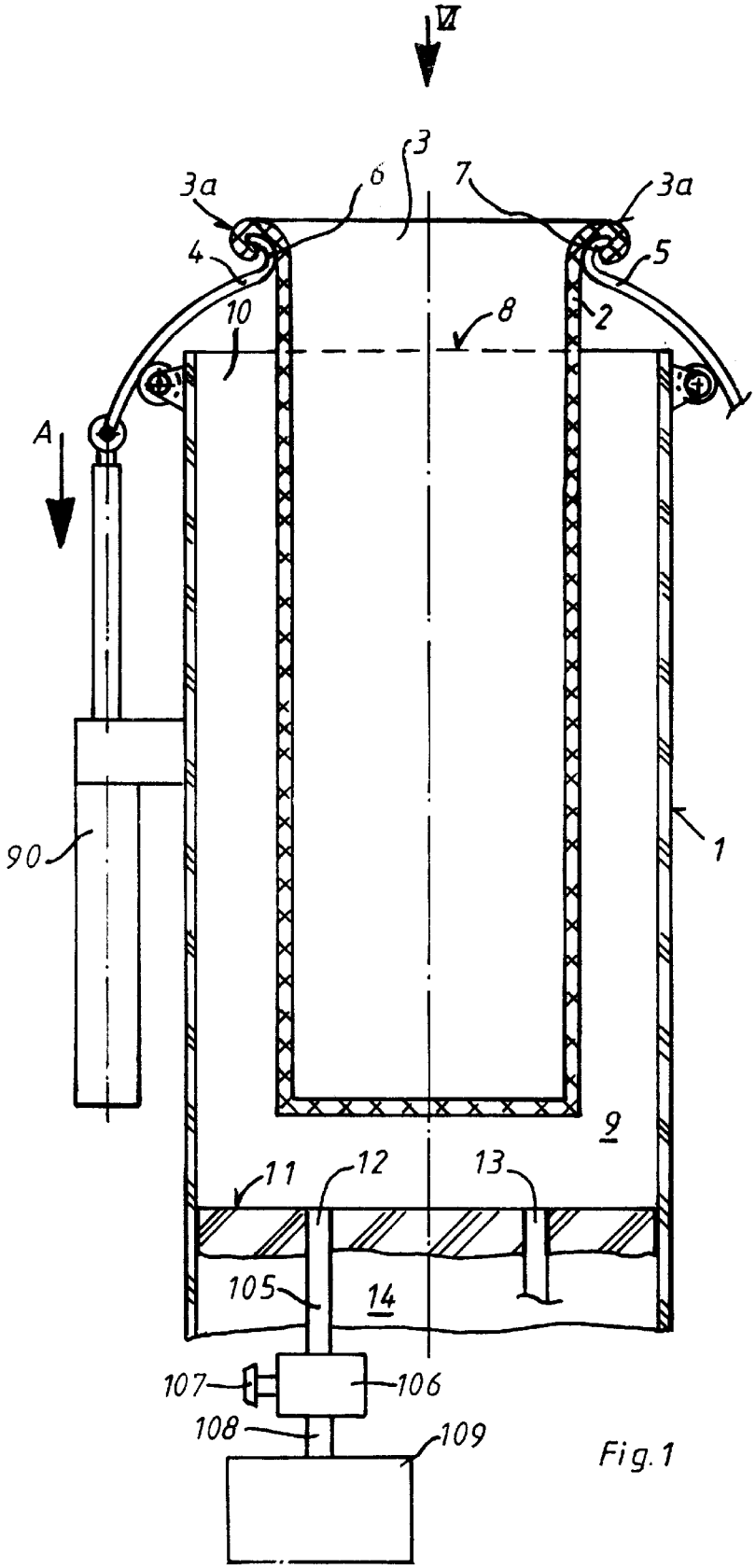
FIG. 1 shows a partial section through the device for the packaging of an article by means of an elastic bag.

FIG. 1 shows a receptacle (1) in which a bag (2) consisting of an elastic foil is placed. The bag (2) is suspended on retaining means (4, 5) with the edge of its opening (3). The retaining means (4, 5) have hook-shaped ends (6, 7) over which the edge **(3*a*) of the bag (2) is laid. The edge tension retains the bag (2) with its edge (3*a*) on the hooks (6 and 7)**.

The bag (2) is located in unexpanded state in a space (9) of the receptacle (1). The receptacle (1) has an opening (10) and at the opposite wall (11) holes (12, 13) as a connection to a device (vacuum pump (109)) generating a partial vacuum.

Between the vacuum pump (109) and the space (9) a valve (106) is provided. By means of the valve (106), the extraction and intake of the air from the space (9) and into the space (9) are regulated. To extract the air from the space (9), the valve (106) is switched in such a way that an opening (107) through which the air can flow in is closed and the vacuum pump (109) extracts the air from the space (9) via lines (105, 108).

If the space (9) is to be filled with air again after the placing of an article into the bag (2), the valve (106) makes a connection between the opening (107) and the line (105) so that air can flow from the external space into the space (9). During this procedure a valve (106) blocks off the line (108) to the vacuum pump (109).

A corresponding device can also be provided behind the hole (13). It is, however, also possible to connect the hole (13) via a line with the line (105).

Figure 2:
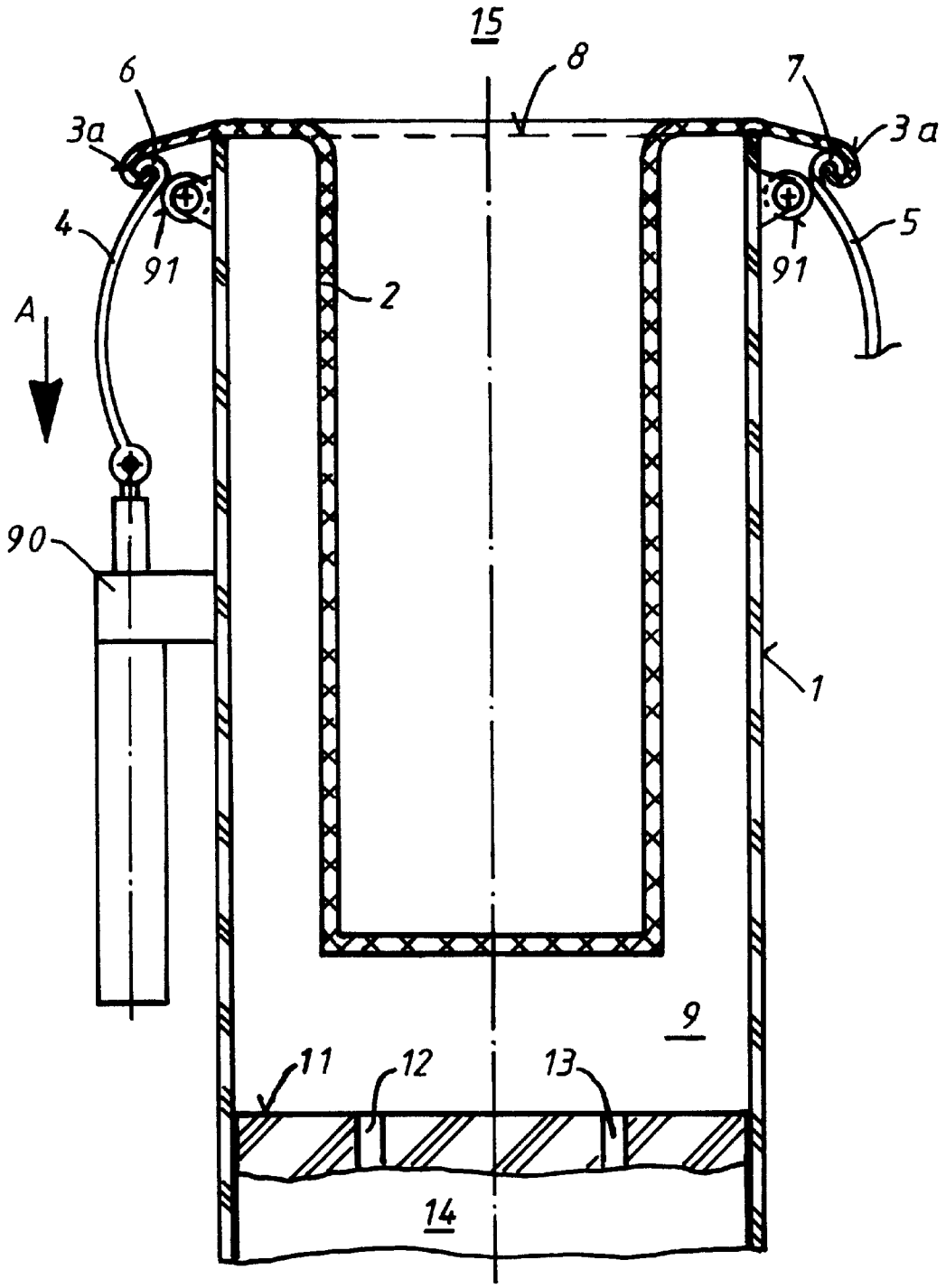
FIG. 2 shows the device according to FIG. 1 with the opening of the bag expanded.

FIG. 2 shows the bag (2) in the receptacle (1). The retaining means (4,5) have been moved by means of a hydraulically, pneumatically or electrically operating tensioning device (90) in the direction of the arrow (A) via provided rollers (91) and have spread the retaining means (hooks (6, 7)) on withdrawing in such a way that the edge **(3*a*) of the bag (2) is expanded in such a way that the edge (3*a*) of the bag (2) seals the space (9) of the receptacle (1) against the external air (15)** and thus against the external air pressure.

Figure 3:
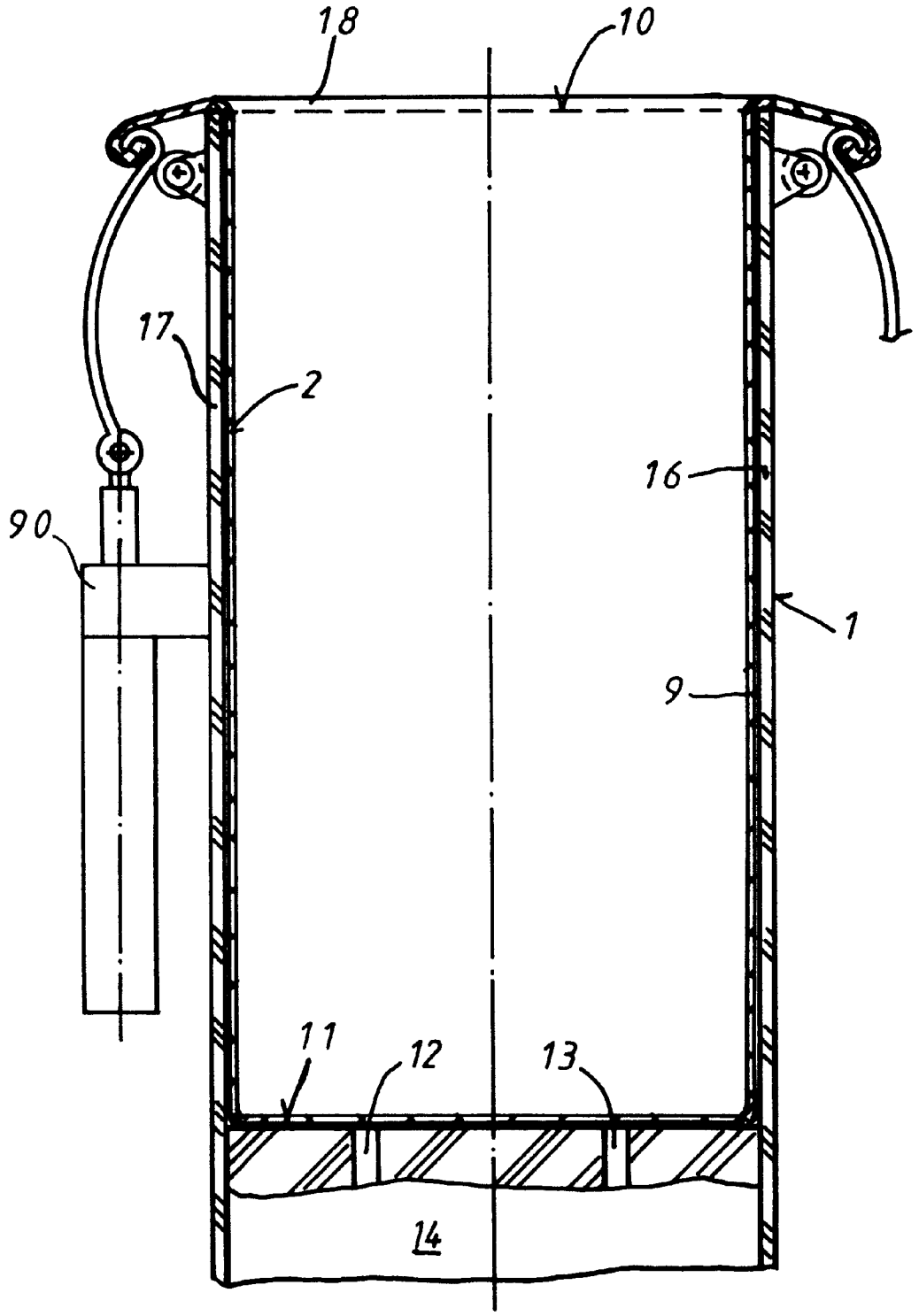
FIG. 3 shows the device according to FIG. 1 with the bag expanded.

According to FIG. 3, an atmospheric partial vacuum has been generated in the space (9) through extraction of air from the space (9) by means of a device (14) (not shown), so that the bag (2) clings to the inner sides of the walls (11, 16, 17) of the receptacle (1). The bag (2) is now in an expanded state.

Figure 4:
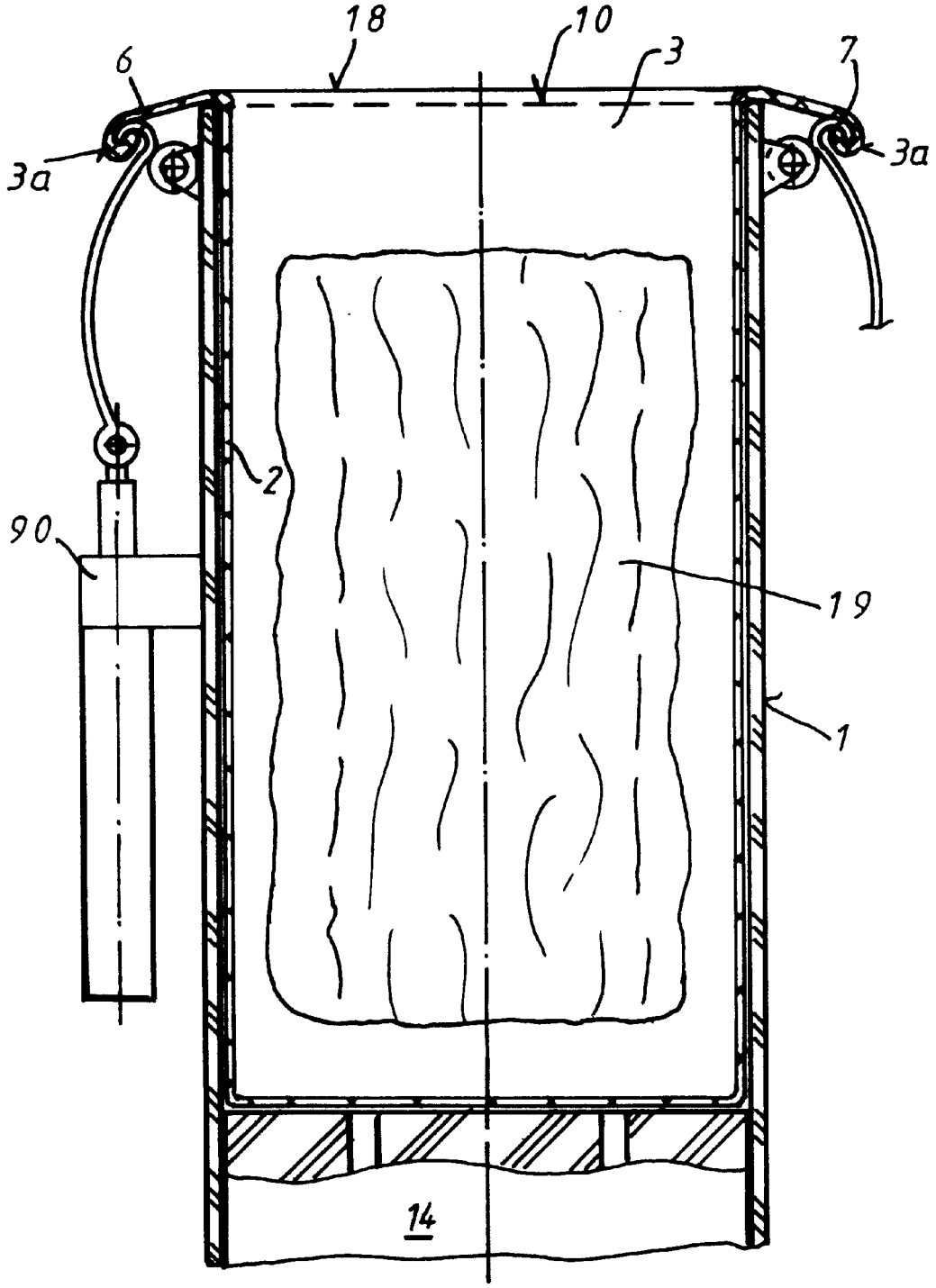
FIG. 4 shows the device according to FIG. 1 with the an article to be packaged placed in the bag.

According to FIG. 4, an article (19) to be packed can now be guided through the opening (10) of the receptacle (1) and the opening (18) of the bag into the receptacle (1) and the bag (2) without mechanical means being in the way during this procedure.

Figure 5:
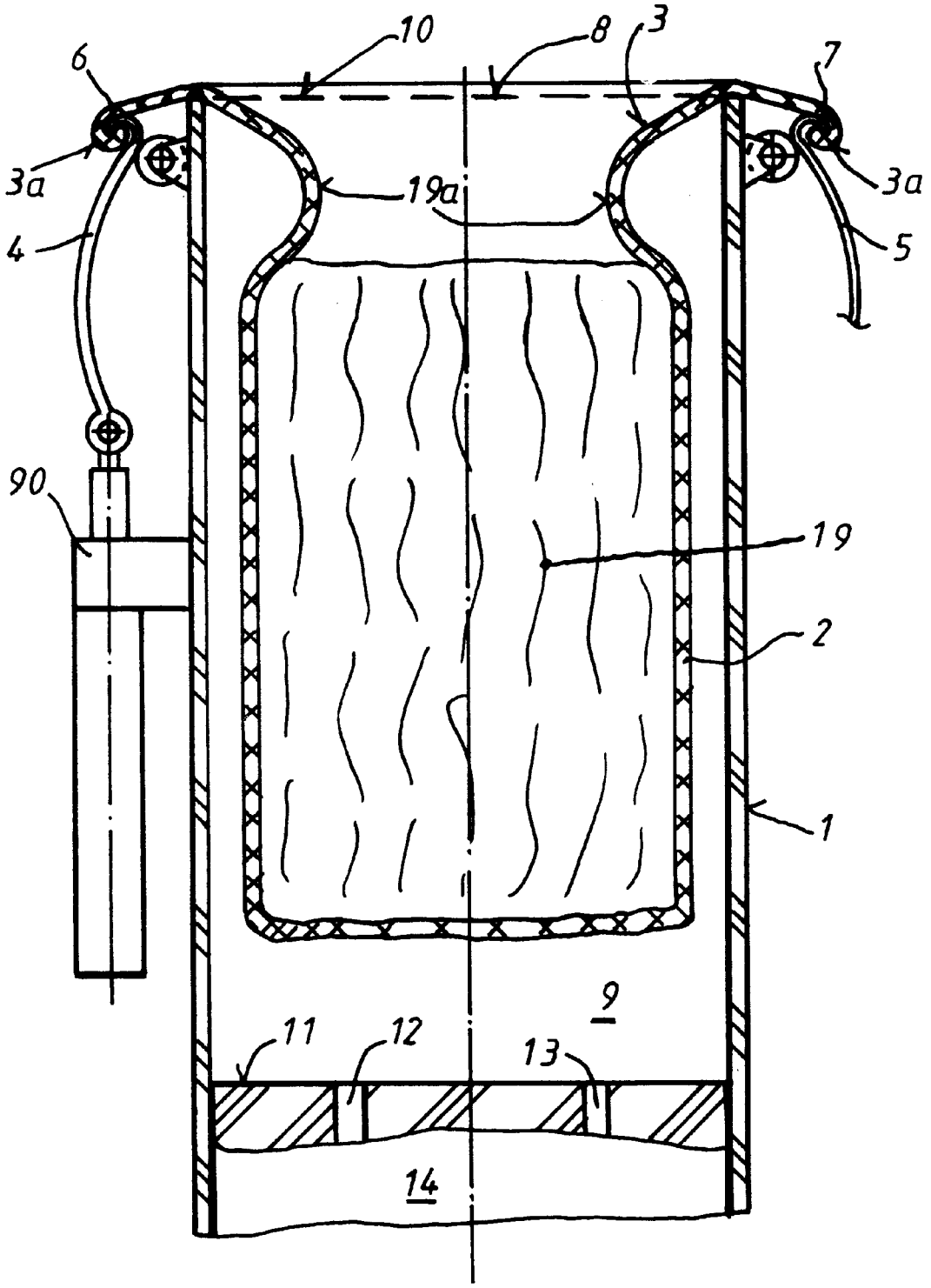
FIG. 5 shows the device according to FIG. 1 with a bag placed against the article to be packaged.

According to FIG. 5, the article (19) is in the bag (2), and the partial vacuum in the space (9) of the receptacle (1) has been released, so that the bag (2) has clung automatically on account of its elasticity to the inserted article (19), where applicable under exertion of a pressure onto the article (19). In this procedure the air between the article (19) and the bag (2) is displaced.

Air can flow unimpeded through the opening (10) of the receptacle (1) and the opening (3) of the bag (2) into the front area of the bag (2) in the space between the inserted article (19) and the edge **(3*a*) of the bag still retained by the hooks (6, 7). Between the opening (3) of the bag (2) and the packaged article (19), the bag (2) contracts annularly in the area (19*a*)**.

The tensile forces exerted on the hooks are eliminated (not shown).

The bag (2) is then lifted with its edge **(3*a*) from the retaining means (4, 5), and the packaged article (19) can be withdrawn from the receptacle (1) through the opening (10). The retaining means (4, 5) do not disturb this procedure, as they are flexibly mounted in their attachments points at the tensioning means (90)**.

Figure 6:
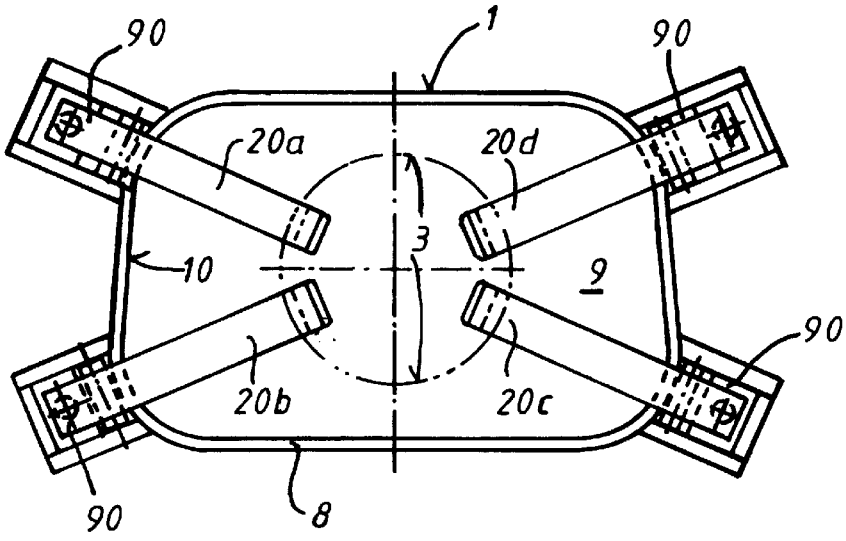
FIG. 6 shows the top view onto the device according to FIG. 1 in the direction of the arrow VI.

As is to be gathered from FIG. 6, the receptacle (1) has four hook-shaped retaining devices **(20*a*, 20*b*, 20*c*, 20*d*) which expand the opening (3) of the bag (2) by means of the tensioning means (90) and pull said opening over the edge (8) of the receptacle (1). The receptacle (1)** has in the present embodiment an approximately rectangular cross section in order to be able to package joints of meat readily airtight with the device.

The retaining devices according to FIGS. 1 through 6 are also to be used for a packaging sleeve.

Figure 7:
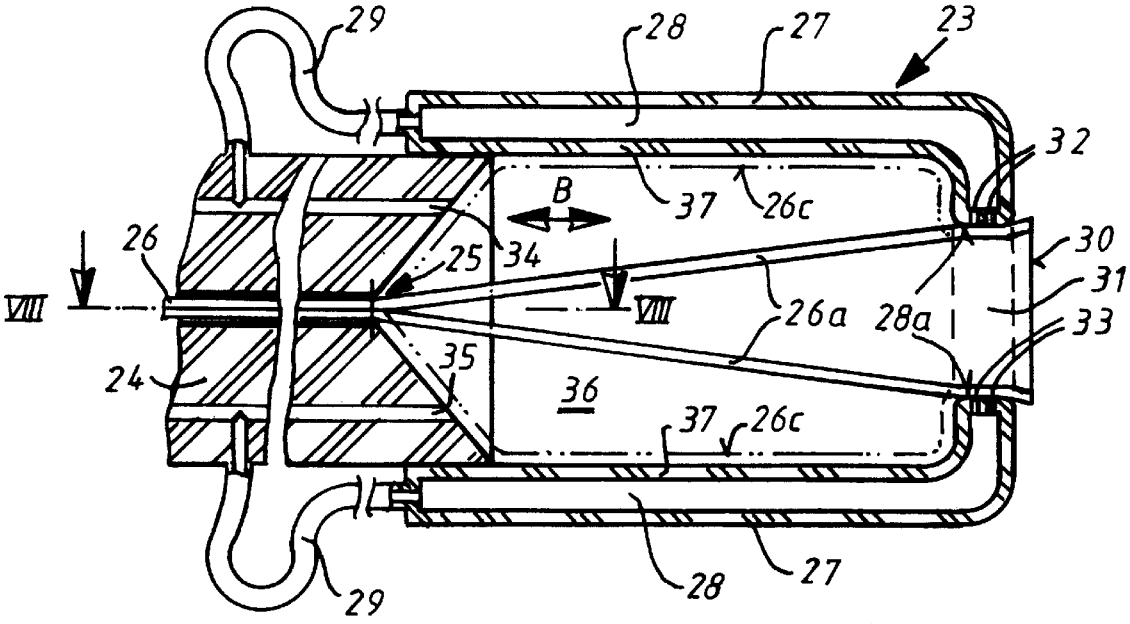
FIG. 7 shows a modified embodiment of the packaging of an article by means of an elastic packaging sleeve.
Figure 9:
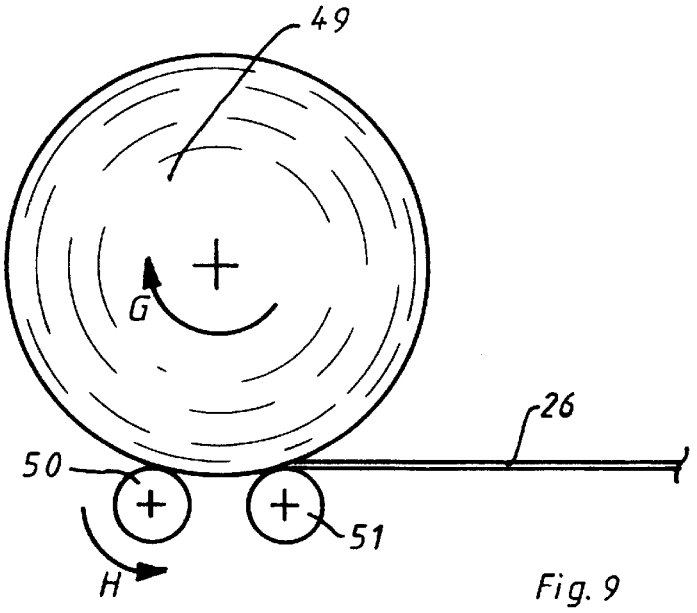
FIG. 9 shows a detail of the device according to FIG. 7.

According to FIG. 7, one sleeve portion **(26*a*) respectively is used from a longer elastic sleeve (26) which is withdrawable according to FIG. 9 from a dispenser roll (49)**.

According to FIG. 7, the elastic sleeve is guided by a piston (24) in a receptacle (23) into the space (36) provided to take the packaging material. The piston (24) has for this purpose an infeed opening (25) for the sleeve portion **(26*a*). The receptacle (23) is of two-walled design in this embodiment, which is, however, not compulsory. The receptacle (23) has between the walls (27 and 37) a cavity (28) in which a partial vacuum is generated via lines (29). The sleeve portion (26*a*) can for its part, as shown in FIGS. 1 through 6, be elastically expanded by generation of a partial vacuum in the space (36)**.

In modification of the embodiment according to FIGS. 1 through 6, the sleeve end (30) is fixed in the opening (31) of the receptacle (23) in such a way that a partial vacuum is generated in the cavity (28) between the walls (27 and 37) of the receptacle (23). Through openings (32, 33) the front end of the sleeve portion **(26*a*) is drawn in at the edges (28*a*) of the double wall in the area of the opening (31) through the generation of the partial vacuum In the space (28). A partial vacuum is then generated via openings (34, 35) in the space (36) enclosed by the double walling, so that the sleeve portion (26*a*) clings to the inner sides (37) of the receptacle (23), as shown in FIG. 3**.

Through this embodiment, an article for its part can be introduced into the expanded elastic sleeve portion **(26*c*)** (broken line).

This device is appropriate especially when liquid or pasty articles in the interior of the receptacle are to be introduced into the packaging. In the case of liquid or pasty articles it is not necessary for the opening (31) to correspond to the maximum diameter of the article to be introduced.

The inner walling of the double wall can in a further embodiment of the invention (not shown) be replaceable.

In this receptacle, the bag (2) is also placeable in the same way as in FIGS. 1 through 6.

The piston (24) is configured displaceably in the direction of the arrow (B), so that variously long sleeve portions (26*a*) can be placed in the receptacle and corresponding articles can be packaged. Thus, receptacle (23) has an adjustable length (L).

Figure 8:
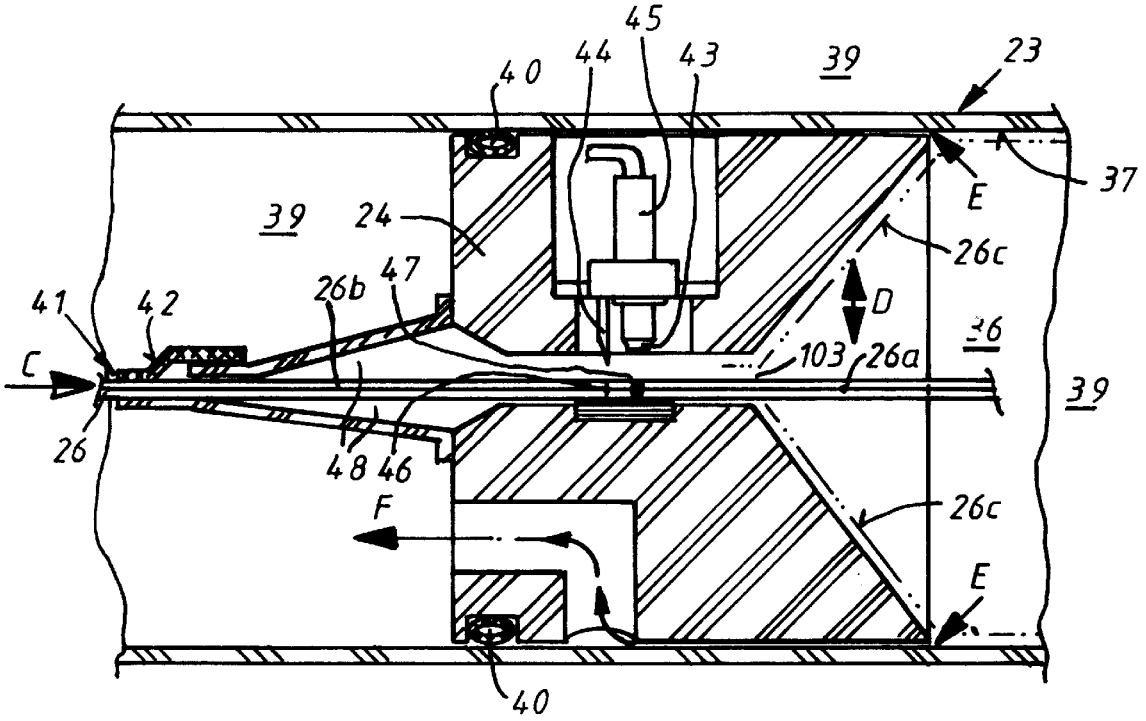
FIG. 8 shows a section according to line VIII—VIII of FIG. 7.

FIG. 8 shows the device with the piston (24) of FIG. 7 in the continuation of the device to the left. To seal the space (36) with the sleeve outlet (103), in which space a partial vacuum is generated as compared with the external air (39), a seal (40) is provided between the piston (24) and the receptacle wall (37). The seal (40) is a hollow seal and can be configured inflatable, so that it can be used on the one hand to seal the space (36), but on the other hand also to fix the piston (24) in its respective position.

According to FIG. 9, the sleeve portion (26*a*) is advantageously drawn from a dispenser roll (49). The packaging sleeve (26) drawn from the dispenser roll (49) is guided in the direction of the arrow (C) into a sleeve inlet (41). In order to guarantee an approximately tight seal of the sleeve inlet (41) against the external air pressure, a resilient sealing device (42) is provided here.

To expand the sleeve portion (26*a*), a partial vacuum is generated for its part in the space (36) in that the air present in the space (36) is extracted in the direction of the arrows (E and F).

After generation of the partial vacuum, the external air pressure acts inside the sleeve portion (26*a*) via the opening (31) (FIG. 7) on the sleeve portion (26*a*) and expands said sleeve portion as far as the position (26*c*) marked with a broken line, so that the sleeve portion practically fills out the space (36).

According to FIG. 8, a sleeve portion (26*b*) is simultaneously pre-opened but not expanded in a space (48) upstream from the piston (24) by the air pressure acting from outside.

This has the advantage that the sleeve portion (26*b*) can be more readily opened after removal of the sleeve portion (26*a*) from the device, as the adhesion forces which act between two foil lengths are countered by the pre-opening or the adhesion forces are cancelled completely. Through the pre-opening, the utilization of release agents such as powder and the like is virtually eliminated in the production of the packaging sleeve.

In the piston (24) are located a welding rail (43) and a perforation blade (44) which can be moved in the direction of the arrow (D) by means of a pneumatic cylinder (45) in order to apply a weld seam (47) and a perforation line between the sleeve portion (26*a*) and the follow-on sleeve (26) in a zone (46).

It is also possible to deactivate the action of the welding device, so that only a perforation for tearing off a sleeve portion after the packaging of the article and for removing the packaged article from the space (36) is generated in the sleeve passing through.

According to FIG. 8, the piston is configured conically enlarging, starting from the sleeve outlet (103), on its side facing the space (36). It is, however, also possible to provide other configurations of the piston (24).

According to FIG. 9, the sleeve (26), as already stated, is placed on a dispenser roll (49). Prior to generation of the partial vacuum in the space (36), the sleeve portion (26*a*) is tightened in the space (36) so that it does not cling in folds and/or in creases to the inner wall of the receptacle (23). For this purpose the dispenser roll (49) is turned back in the direction of the arrow (G) once the sleeve end (30) is fixed at the opening (31) of the receptacle (23). The dispenser roll (49) is mounted on two rollers (50 and 51) which are freely rotatable during the pulling of the sleeve (26) from the roll (49). To tighten the sleeve (26), the roller (50) is turned back in the direction of the arrow (H) so that the dispenser roll (49) is moved back in the direction of the arrow (G) and tightens the sleeve (26). In that the roll (49) is driven by the roller (50), a uniformly large torque always acts on the dispenser roll (49), irrespective of the diameter of the roll (49), which diameter is independent of the sleeve supply still present on the roll (49).

Figure 10:
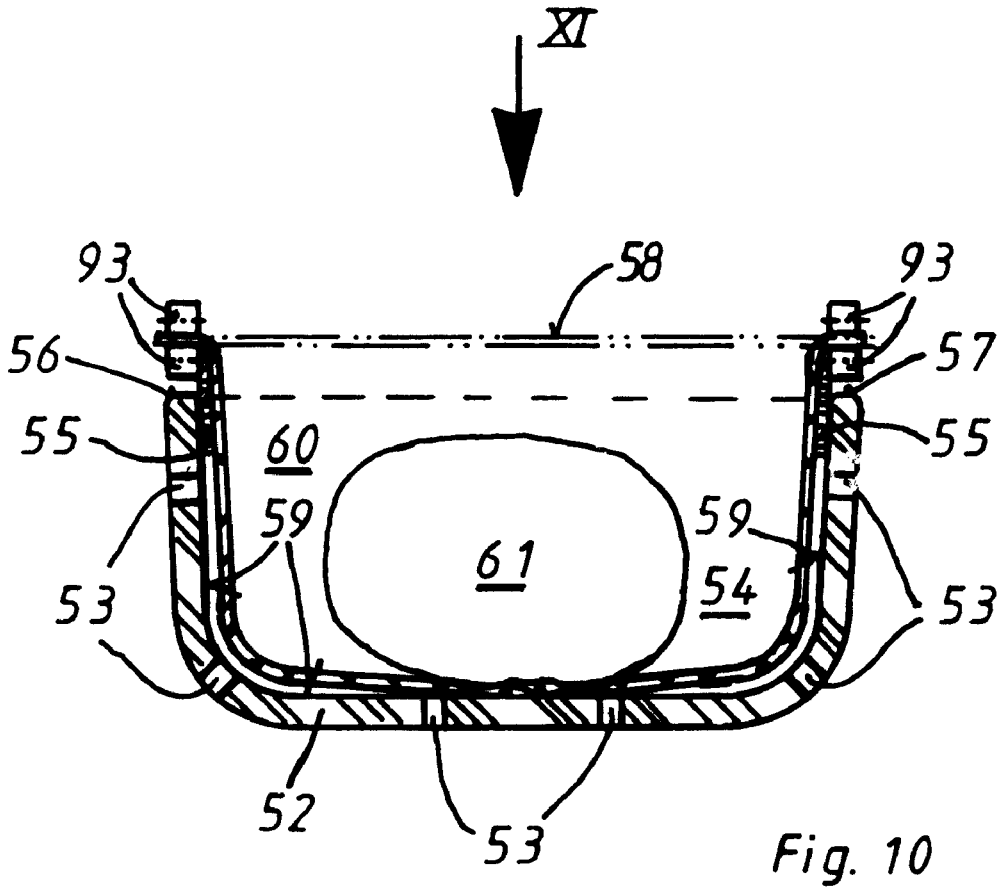
FIG. 10 shows a modified embodiment of the packaging of an item by means of an elastic monoplane foil.
Figure 11:
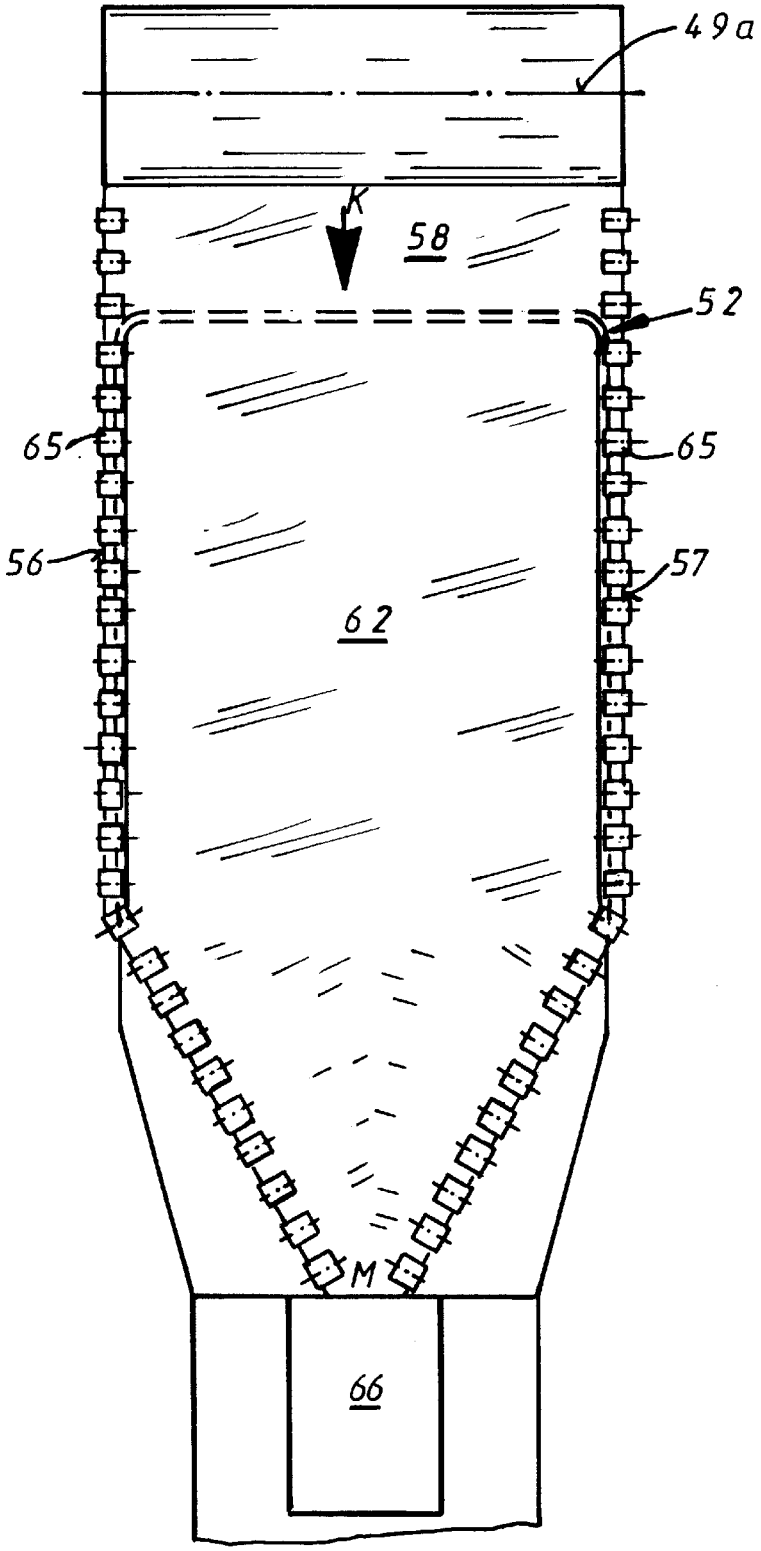
FIG. 11 shows a top view onto FIG. 10 in the direction of the arrow XI.
Figure 12:
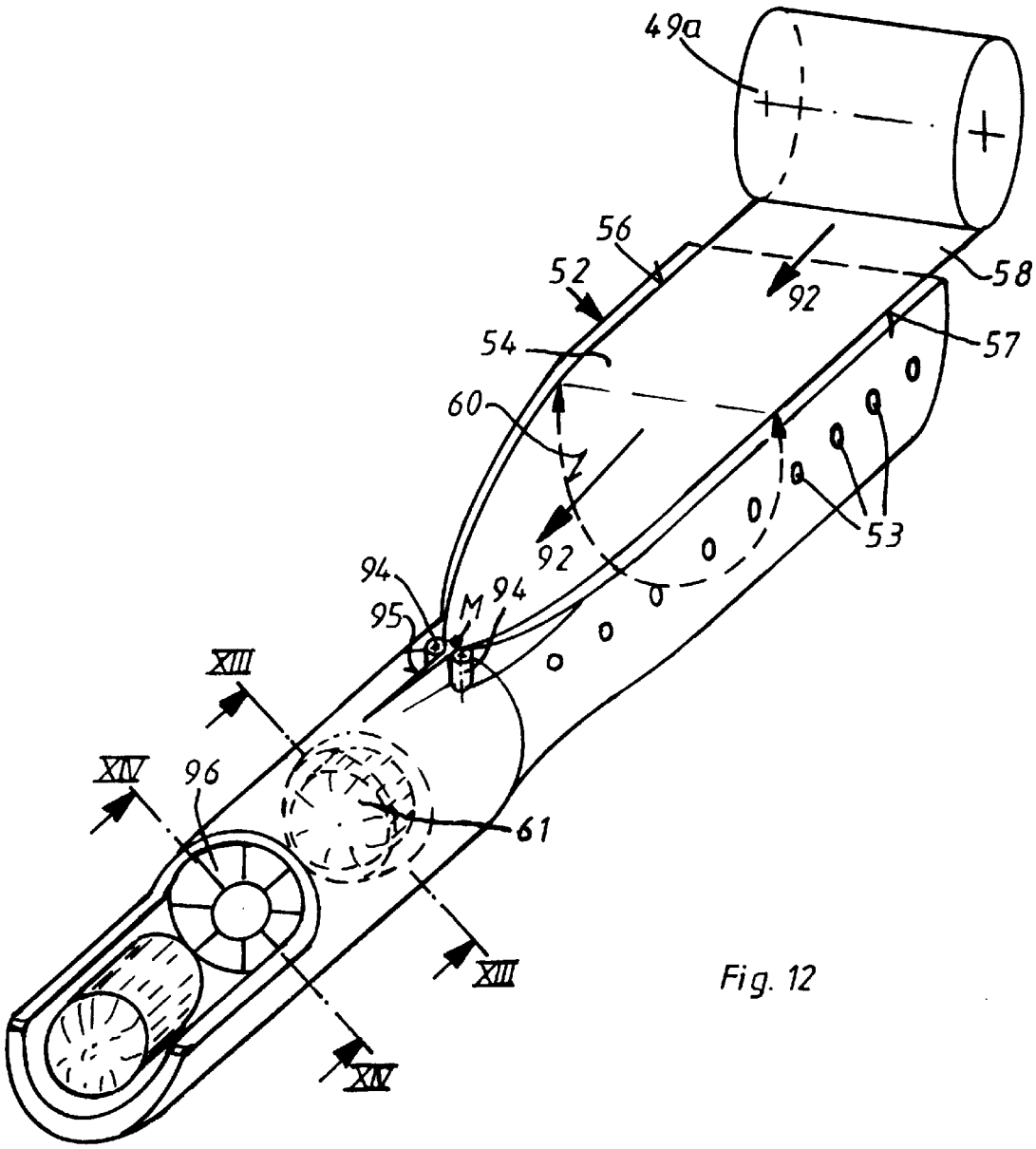
FIG. 12 shows a perspective view of the device according to FIG. 10.

FIGS. 10, 11 and 12 show a receptacle (52) in trough form, which receptacle has openings (53). The openings (53) are in connection with a device which allows a partial vacuum to be generated in the space (54).

An elastic monoplane foil (58) is guided in the direction of the arrow (K) over a sealing lip (55) located at the edge of the receptacle (52), which foil is withdrawable from a dispenser roll (49*a*). The monoplane foil (58) and the receptacle (52) limit the space (54) in which a partial vacuum is generated.

According to FIG. 10, the monoplane foil (58) clings at least partially to the Inner walling (59) of the receptacle (52) on account of the partial vacuum generated. An article (61) to be packaged can be placed in a depression (60) thereby resulting in the monoplane foil on account of its elasticity.

The monoplane foil is moved in the direction of the arrow (92) (FIG. 12) by means of transport means. A large number of roller pairs (65,93) can be provided as transport means according to FIG. 10. The space (54) and its transport means are designed in such a way (FIG. 12) that the edges (56, 57) of the monoplane foil (58) run together in area (M), so that they can be welded together there by means of two welding rolls (94) in a welding device (66). A sleeve thus results from the monoplane foil, in which sleeve the article (61) is located.

The sleeve is transported with the article (61) through an air lock (96). Once the partial vacuum has been released, the monoplane foil clings to the article (61) to be packaged, as did the sleeve portions or bag according to the preceding embodiments.

Figure 13:
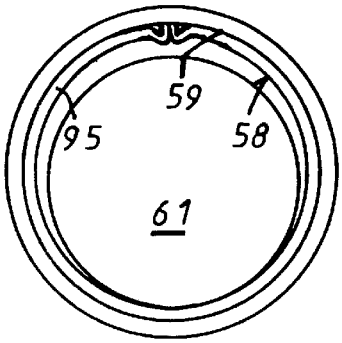
FIG. 13 shows a section according to line XIII—XIII of FIG. 12.

FIG. 13 shows the packaged article (61) in the still expanded sleeve (95) formed from the foil (58).

Figure 14:
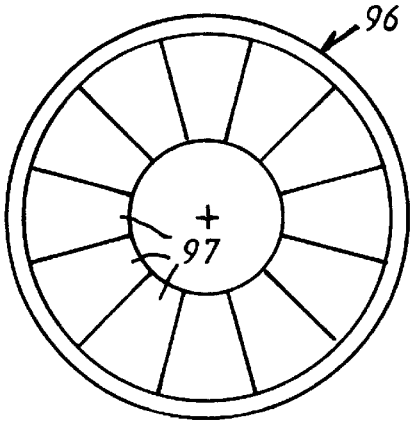
FIG. 14 shows a section according to line XIV—XIV of FIG. 12.

The air lock (96) can consist of overlapping rubber lips (97) (FIG. 14) which are flexibly configured in transport direction of the packaged commodity.

With this device, successive articles can be packaged.

Figure 15:
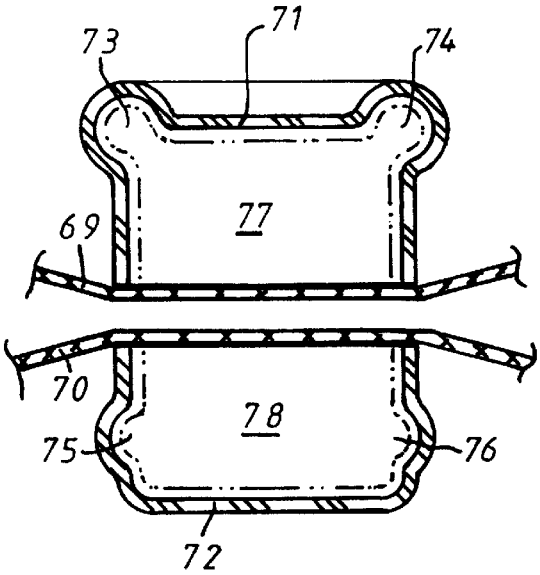
FIG. 15 shows a modified embodiment.

According to FIG. 15, the device according to the invention has two receptacles (71, 72) located opposite each other. With this configuration, two monoplane foils (69, 70), each of which is allocated to a space (77, 78) of the receptacles (71, 72), can be guided over the receptacles (71, 72).

In a further embodiment of the invention, the receptacles can be configured in such a way as shown in FIG. 15. The receptacles located opposite each other have bulges (73, 74 and 75, 76 respectively) into which the monoplane foils (69, 70) are drawn on generation of the partial vacuum.

The monoplane foils (69, 70) can be over expanded in the bulges (73, 74, 75, 76), as shown by means of FIG. 15, so that after release of the partial vacuum the monoplane foils (69, 70) have over expanded areas at which their restoring forces are approximately zero. These local overexpansions are desired if the commodity to be packaged has, for example, edges at which the edge pressure would be too great after packaging with the monoplane foils (69, 70). Through the overexpansions of the monoplane foils (69, 70) it is achieved that the edge pressure can be deliberately released and reduced.

An over expansion of the packaging material can be achieved with all devices according to FIGS. 1 through 12 if the described bulges (73, 74, 75, 76) are applied in the same way to the receptacles according to FIGS. 1 through 12.

Figure 16:
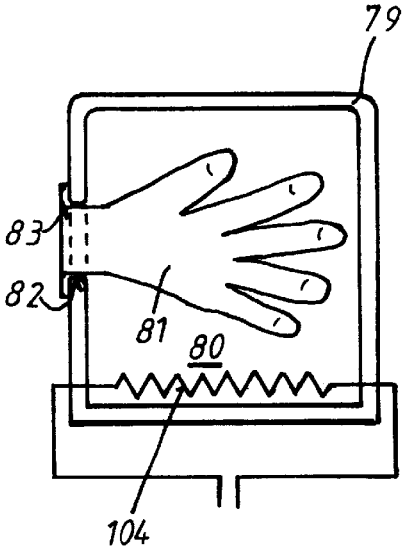
FIG. 16 shows a device for putting on an elastic glove.

FIG. 16 shows as a further embodiment a receptacle (79). An elastic glove (81) has been placed in a space (80) of the receptacle (79). In accordance with the embodiments according to FIGS. 1 through 6, such a partial vacuum is generated in the space (80) that the glove (81) is expanded to such an extent that a hand can comfortably be inserted. A person's hand can thus be readily inserted Into the glove (81) through an opening (82) of the receptacle (79) as well as through an opening (83) of the glove (81). Once the partial vacuum has been released, the glove then clings to the hand.

According to FIG. 16, an electrically driven heating coil (104) is provided in the space (80). By means of this coil (104), the internal space and thus the elastic glove can be heated so that, with appropriately selected elastic glove material, the material is stress-relieved after fitting of the glove onto the user's hand, i.e. exerts no further sustained pressure on the user's hand.

Figure 17:
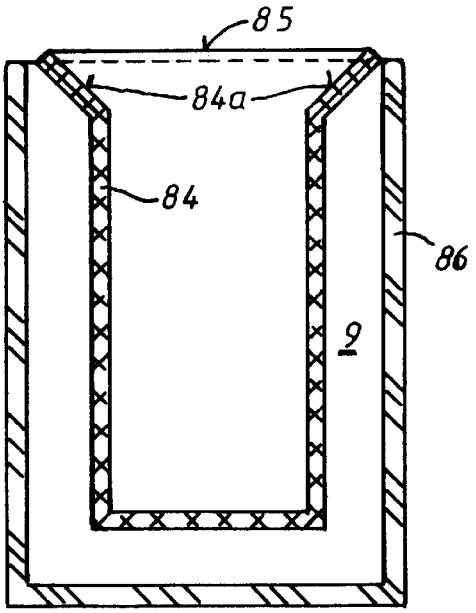
FIG. 17 shows a modified detail of FIG. 1.

According to FIG. 17, a receptacle (86) as was shown in FIGS. 1 through 8 is represented, which receptacle has no special retaining and opening means for the opening of a bag or sleeve. The edge of the bag or sleeve is placed, for example by hand, at the edge of the receptacle (86) under utilization of the elasticity as represented in FIG. 18.

FIG. 17 shows moreover an unexpanded bag (84) in the receptacle (86). The opening (85) of the bag (84) now has, however, a large diameter than the bag (84) itself. This has the advantage that, when placing the bag (84) with a taper (84*a*) at the all-round edge of the receptacle (86), said bag can be fixed more readily, manageably for housewives too for example, at the edge of the receptacle (86) without further technical aids (see FIG. 18).

Figure 18:
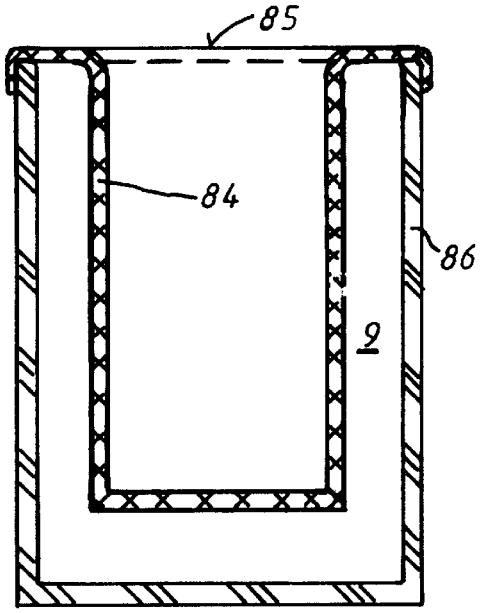
FIG. 18 shows a modified detail of FIG. 1.
Figure 19:
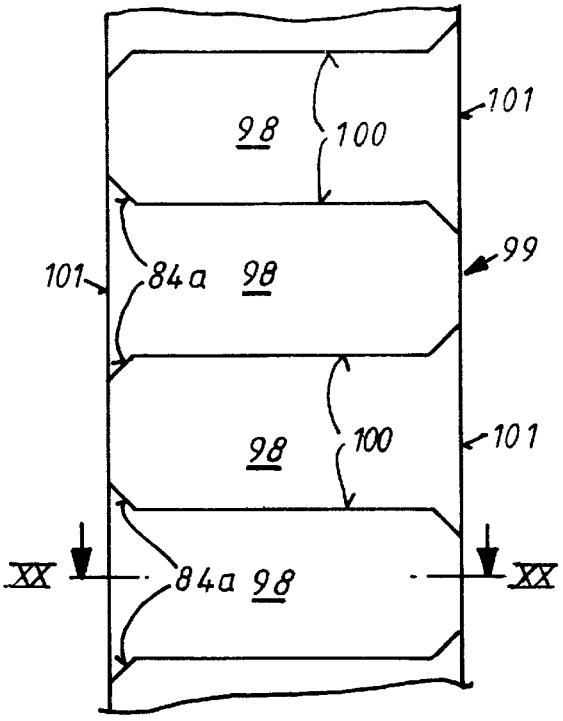
FIG. 19 shows a modified embodiment.
Figure 20:
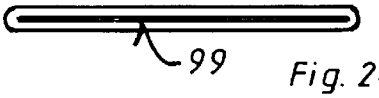
FIG. 20 shows a section according to line XX—XX of FIG. 19.

This type of bag configuration according to FIGS. 17 and 18 can be readily produced in that bag portions (98) are punched out or cut out of a foil sleeve (99) (FIGS. 19, 20) along the line (100) and welded or welded out (hot-wire welding) at the edges, which bag portions are separated at their respectively broader ends (101).

Figure 21:
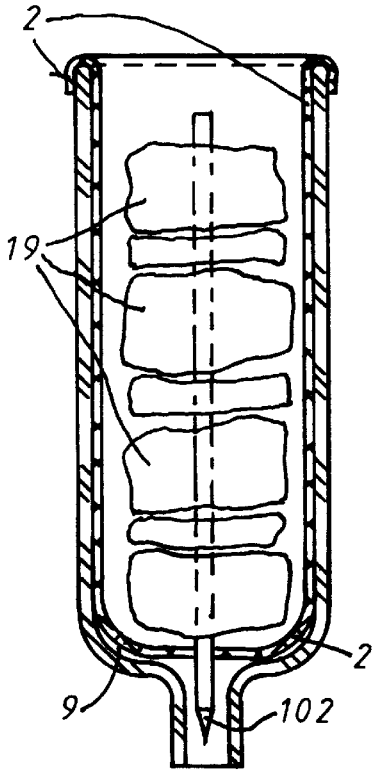
FIG. 21 shows a modified embodiment.

FIG. 21 shows the device according to FIG. 1, which device is, however, modified here in such a way that, after the filling of the article (19) into the receptacle, the bag (2) is pierced by means of a sharp object (102). With this configuration, the external air penetrates abruptly into the space (9), so that a very rapid functional sequence and thus a rapid successive packaging of articles becomes possible.

This configuration has, however, also the advantage that, for example if the article (19) to be packaged is skewered shashlik, the wooden spit onto which the pieces of meat are pushed can take over the piercing of the packaging bag.

Accordingly, while only a few embodiments of the present invention are shown and described, it is obvious that many changes and modifications may be made thereunto without departing from the spirit and scope of the invention.

What is claimed is:

1. A device to package at least one article with an elastic packaging material, comprising: a receptacle (1, 23, 52, 71, 72) in which a partial vacuum is generated, at least two openings disposed in the receptacle, wherein one opening is for inserting the at least one article and a second opening for the infeed of a sleeve (26); said second opening is closed airtight for feeding the sleeve (26); and a piston (24) in which the infeed opening (25) for the sleeve (26) is located.

2. The Device according to claim 1, wherein said piston (24) is located in the receptacle (23).

3. The Device according to claim 2, wherein said piston (24) is located displaceably in the receptacle (23).

4. The Device according to claim 3, wherein said piston (24) is fixable in the receptacle (23).

5. The Device according to claim 4, the devices for welding, cutting and perforating are configured in such a way that the weld seams, cut lines and perforation lines have a curved configuration.

6. The Device according to claim 2, further comprising a thermal welding device (43) is located in the piston (24).

7. The Device according to claim 2, wherein said piston (24) comprises a device (44) for the application of a perforation line into the sleeve (26).

8. A device to package at least one article with an elastic packaging material, comprising: a receptacle (1, 23, 52, 71, 72) in which a partial vacuum is generated, at least two openings disposed in the receptacle, wherein one opening is for inserting the at least one article and a second opening is disposed in the receptacle, said second opening for a sleeve (26); said second opening is closed airtight for feeding the sleeve (26); wherein the feed opening for the sleeve (26) is configured areally enlarging in the direction of the space (36) in such a way that the feed opening has a widened configuration.

9. The Device according to claim 8, wherein the magnitude of the widening corresponds approximately to the magnitude of the slot.

10. A method for packaging articles in a packaging device, comprising the steps of:

feeding an elastic packaging material into a receptacle as a foil sleeve (26) through an airtight initial opening in the receptacle;

feeding a sleeve portion (26*a*) having an open end through the receptacle;

placing at least one displaceable mechanical means on the open end of the sleeve portion in the receptacle such that all edges of the receptacle are contacted and overlapped forming a space (36), said space being airtight from an external atmosphere;

generating an atmospheric partial vacuum in said space (36) for expanding the sleeve portion (26*a*);

inserting at least one article into the sleeve portion (26*a*);

restoring the shape of the sleeve portion such that it clings to the article; and separating the sleeve portion from the fold sleeve (26).

11. The Method according to claim 10, wherein the elastic packaging material clings at least partially to the at least one article to be packaged and exerts a pressure acting through the elastic restoring forces of the packaging material on the at least one article to be packaged.

12. The Method according to claim 10, during insertion of the article to be packaged into the packaging material, the packaging material is provided with at least one opening in such a way that the partial vacuum is released.

13. The Method according to claim 10, wherein the packaging material (2, 26, 58, 69, 70) is closed on at least one side (3).

14. The Method according to claim 10, wherein the sleeve portion (26*a*) is tightened in the receptacle (23) after the placing at the all-round edge of the receptacle (23).

15. The Method according to claim 10, wherein the end (30) of the sleeve portion (26*a*) placed at the edge of the receptacle (23) is released from the edge of the receptacle (23) after the release of the partial vacuum.

16. The Method according to claim 10, characterized in that the sleeve portion (26*a*) is closed at least one end (30).

17. The Method according to claim 10, wherein the sleeve portion (26*a*) into which the article to be packaged has been inserted is separated from the sleeve (26).

18. The Method according to claim 10, wherein a perforation is formed between the sleeve portion (26*a*) and the sleeve (26).

19. The Method according to claim 10, wherein the beginning of the sleeve portion (26*b*) following the sleeve portion (26*a*) is pre-opened by the external air pressure acting in the sleeve portions (26*a*, 26*b*).

20. The Method according to claim 10, wherein the partial vacuum is generated between the receptacle (1, 23, 52, 71, 72) and the elastic packaging material (2, 26, 58, 69, 70) in such a way that the packaging material (2, 26, 58, 69, 70) clings at least partially to the at least one wall of the receptacle (1, 23, 52, 71, 72).

21. The Method according to claim 10, wherein the partial vacuum is generated between the receptacle (1, 23, 52, 71, 72) and the elastic packaging material (2, 26, 58, 69, 70) in such a way that the elastic packaging material (2, 26, 58, 69, 70) is expanded to such an extent that a clearance remains between the at least one receptacle and the elastic packaging material (2, 26, 58, 69, 70).

22. The method according to claim 10, further comprising the step of thermal welding for closing the ends connecting the lateral edges and ends of the packaging material.

23. The Method according to claim 10, wherein a weld seam lying transverse to the running direction of the packaging material has a curved configuration.

24. The Method according to claim 10, wherein a perforation line is provided for separation of the continuous packaging material (26, 58, 69, 70) is placed transverse to the running direction of the packaging material.

25. The Method according to claim 24, said perforation line lying transverse to the running direction of the packaging material has a curved configuration.

26. The Method according to claim 10, wherein local overexpansions are generated in the packaging material (2, 26, 58, 69, 70).

27. The Method according to claim 26, said local overexpansions are formed by the geometry (73, 74, 75, 76) of the receptacle (71, 72).

28. The Method according to claim 10, the packaging material is heated after the release of the partial vacuum.

29. The device according to claim 1, wherein the at least one article is a meat product.

30. A method for packaging meat products in a packaging device, comprising the steps of:

feeding an elastic packaging material into a receptacle as a foil sleeve (26) through an airtight initial opening in the receptacle;

feeding a sleeve portion (26*a*) having an open end through the receptacle;

placing at least one displaceable mechanical means on the open end of the sleeve portion in the receptacle such that all edges of the receptacle are contacted and overlapped forming a space (36), said space being airtight from an external atmosphere;

generating an atmospheric partial vacuum in said space (36) for expanding the sleeve portion (26*a*);

inserting at least one meat product into the sleeve portion (26*a*);

restoring the shape of the sleeve portion such that it clings to the meat product; and separating the sleeve portion from the fold sleeve (26).

* * * * *